United States Patent [19]

Mohri

[11] 4,252,642

[45] Feb. 24, 1981

[54] WET-TYPE ROTARY SAND CLASSIFIER

[75] Inventor: Takuo Mohri, Miyazaki, Japan

[73] Assignee: Akae Kikai Kogyo Co., Ltd., Miyazaki, Japan

[21] Appl. No.: 808,215

[22] Filed: Jun. 20, 1977

[30] Foreign Application Priority Data

Jan. 13, 1977 [JP] Japan ..... 52/3140[U]

[51] Int. Cl.[3] ..... B03B 5/56

[52] U.S. Cl. ..... 209/452; 209/488; 209/492

[58] Field of Search ..... 209/240, 255, 261, 270, 209/284, 294, 299, 451, 452, 482, 488, 490, 492

[56] References Cited

U.S. PATENT DOCUMENTS

| | | | |
|---|---|---|---|
| 315,523 | 4/1885 | Lynett | 209/294 |
| 1,917,300 | 7/1933 | Hardinge et al. | 209/452 |
| 2,047,202 | 7/1936 | Hardinge et al. | 209/452 |
| 2,119,414 | 5/1938 | Blanchard | 209/452 |
| 2,286,132 | 6/1942 | Walle | 209/270 |
| 2,314,871 | 3/1943 | De Back | 209/284 |
| 2,836,299 | 5/1958 | Johnson | 209/270 |
| 3,672,505 | 6/1972 | Feteri | 209/294 |

FOREIGN PATENT DOCUMENTS

| | | | |
|---|---|---|---|
| 697276 | 10/1940 | Fed. Rep. of Germany | 209/452 |

*Primary Examiner*—William A. Cuchlinski, Jr.
*Attorney, Agent, or Firm*—Jordan and Hamburg

[57] ABSTRACT

A wet-type rotary sand classifier of this invention is provided with a plurality of helicoid blades which are secured onto the inner surface of the rotary drum along the entire length of the drum with their respective rear ends terminating at the rear end plate of the rotary drum at a desired angle relative to the axis of the rotary drum. Due to the above construction, the sand which has settled onto the inner bottom surface of the rotary drum can be transferred to the rearmost corners formed by the helicoid blades and the rear end plate whereby the thus transferred sand is raised upward by the helicoid blades corresponding to the rotation of the drum without carrying the water dams which are usually formed in the conventional wet-type sand classifier.

5 Claims, 19 Drawing Figures

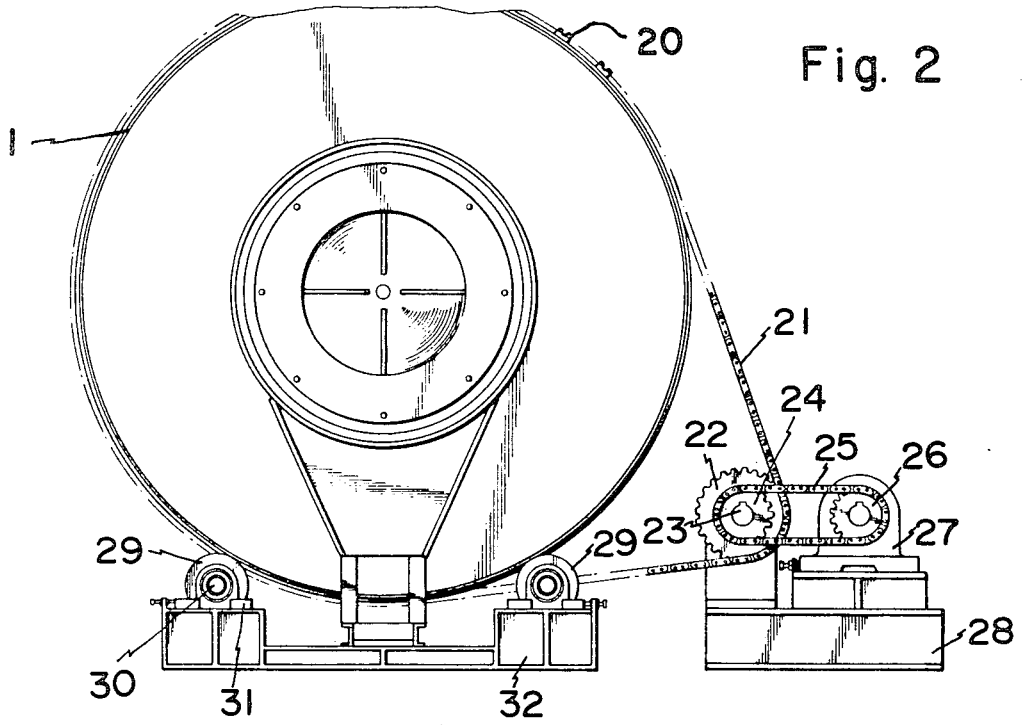
Fig. 2
Fig. 3
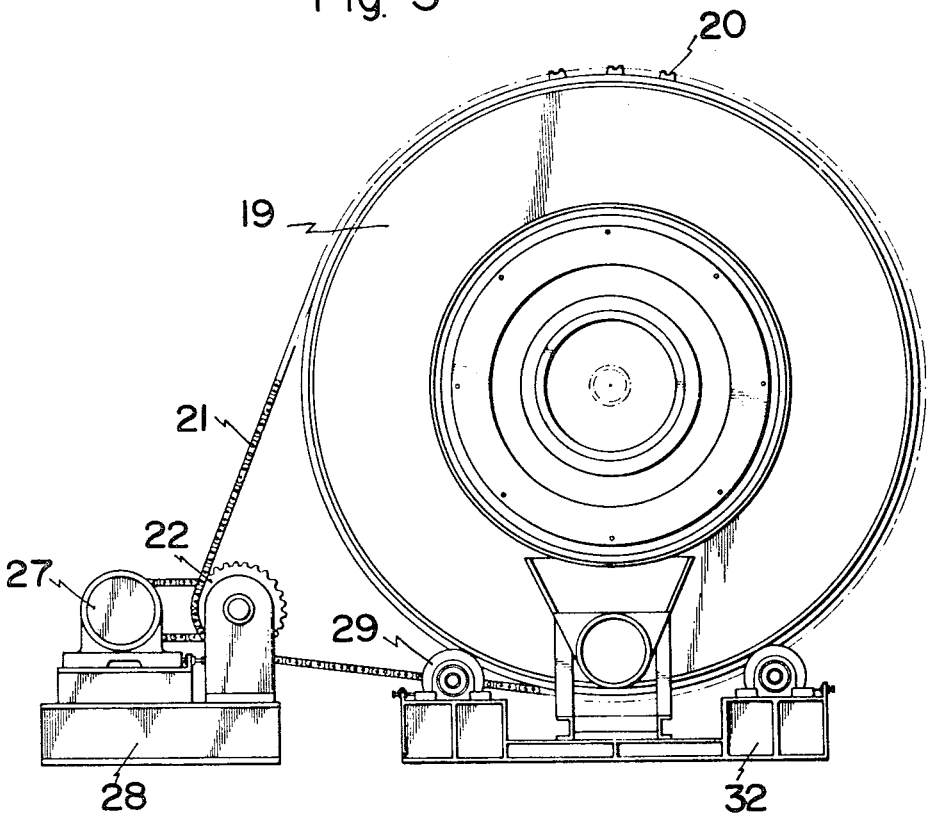

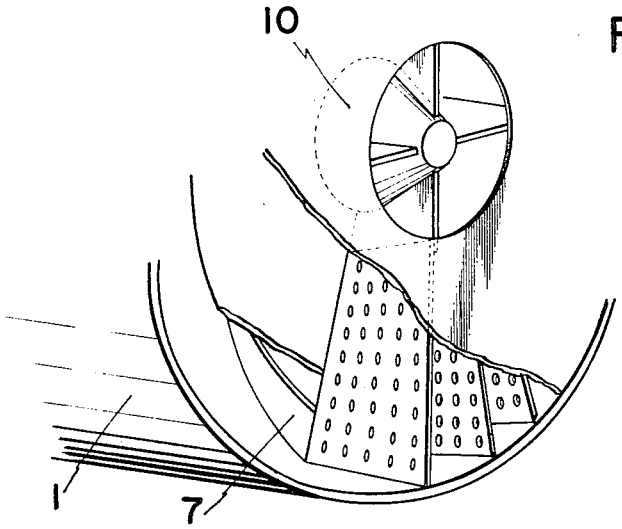
Fig. 8
Fig. 9
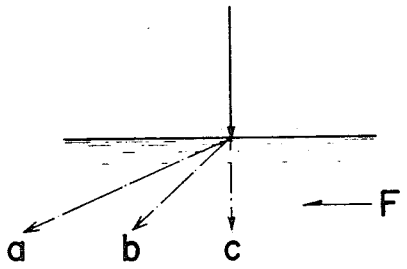
Fig. 10
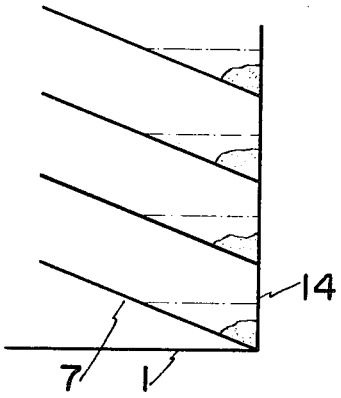

WET-TYPE ROTARY SAND CLASSIFIER

BACKGROUND OF INVENTION

This invention relates to a rotary-type drum sand classifier which can efficiently produce classified sand which is substantially free of water.

In general, the type of sand classifier which the present invention refers to comprises;

(a) a horizontal rotary drum which has a supernatant water outlet at the front end and a sand outlet at the rear end, (b) a plurality of helicoid blades for transferring the settled sand which are secured to the inner surface of the rotary drum along the length of the rotary drum, and (c) a sand discharging means for discharging the above settled sand from the rear outlet of the drum including a plurality of equidistant sand scooping paddles and a cone-shaped discharge chute located at the center of the above scooping paddles.

In the above construction, when the muddy water containing sand is charged into the rotary drum, sand of a desired size distribution is discharged from the rear outlet of the drum while the supernatant water is discharged from the front inlet of the drum.

The applicant of this invention also has disclosed the above type of sand classifier in U.S. Patent Application Ser. No. 759,968 (the C.I.P. of U.S. Patent Application Ser. No. 592,963) which is of great practical merit.

However, referring to the above classifier as shown in FIGS. 7, 8 and 11, at the settled sand discharge end of the drum body a, a plurality of water-separation or scooping paddles b, each of which has a multiplicity of apertures formed therein is radially secured to the inner periphery of the drum 1 in an axial direction. Therefore, the portion or point where the discharge end of the helicoid blade d and the scooping paddle b meet form a considerably acute angle. This implies that the settled sand e which is transferred to the settled sand discharge end by a plurality of helicoid blades tends to accumulate at the deflected or bent portions forming a "dam" between the accumulated settled sand e and the ring-like weir plate f. Therefore, when the paddles provided with those dams are raised upward corresponding to the rotation of the rotary drum, the water defined in the dam is also raised upward. Although a multiplicity of apertures are formed in each scooping paddle, they can not separate the water satisfactorily due to the restriction on the size and number of apertures, therefore the discharged sand still contains a considerable amount of water. Usually, thus produced sand is not directly used as material to produce concrete or construction material since the muddy component contained in the classified sand will ill-affect the rigidity and strength of the construction materials.

Of course, if the thus produced sand is further subject to a water cleaning operation, the muddy component adhering to the classified sand will be removed so that muddy-component-free sand may be produced. Such cleaning operation, however, increases the cost of classification while making the entire classifying operation cumbersome.

Accordingly, it is an object of the present invention to provide a wet-type rotary sand classifier which can resolve the afore-mentioned problems afflicting the conventional apparatuses.

It is another object of the present invention to provide a wet-type rotary sand classifier which can produce a classified sand of improved quality by efficiently separating out the water without necessitating the above cleaning operation.

It is still another object of the present invention to provide a wet-type rotary sand classifier which can conduct the classifying and cleaning operations simultaneously corresponding to the quantity of mud components relative to the muddy water.

It is a further object of the present invention to provide a wet-type rotary sand classifier which has a plurality of apertured helicoid blades for facilitating the rotation of the rotary drum without decreasing the efficiency of the sand transferring operation.

It is a still further object of the present invention to provide a wet-type rotary sand classifier which has a mechanism for preventing the muddy water to influence the settled sand so as to ensure the smooth transfer of the settled sand.

BRIEF DESCRIPTION OF DRAWINGS

FIG. 2 is a rear end view of the above sand classifier.

FIG. 3 is a front end view of the above sand classifier.

FIG. 8 is a schematic view showing the scooping paddles of a conventional apparatus.

FIG. 9 is a schematic view showing the direction of a falling particle in muddy water.

FIG. 10 is a pictorial view showing the portion where the rear ends of the helicoid blades meet the rear end weir plate in the apparatus of this invention.

DETAILED DESCRIPTION OF THE DISCLOSURE

The First Embodiment

Figure 1:
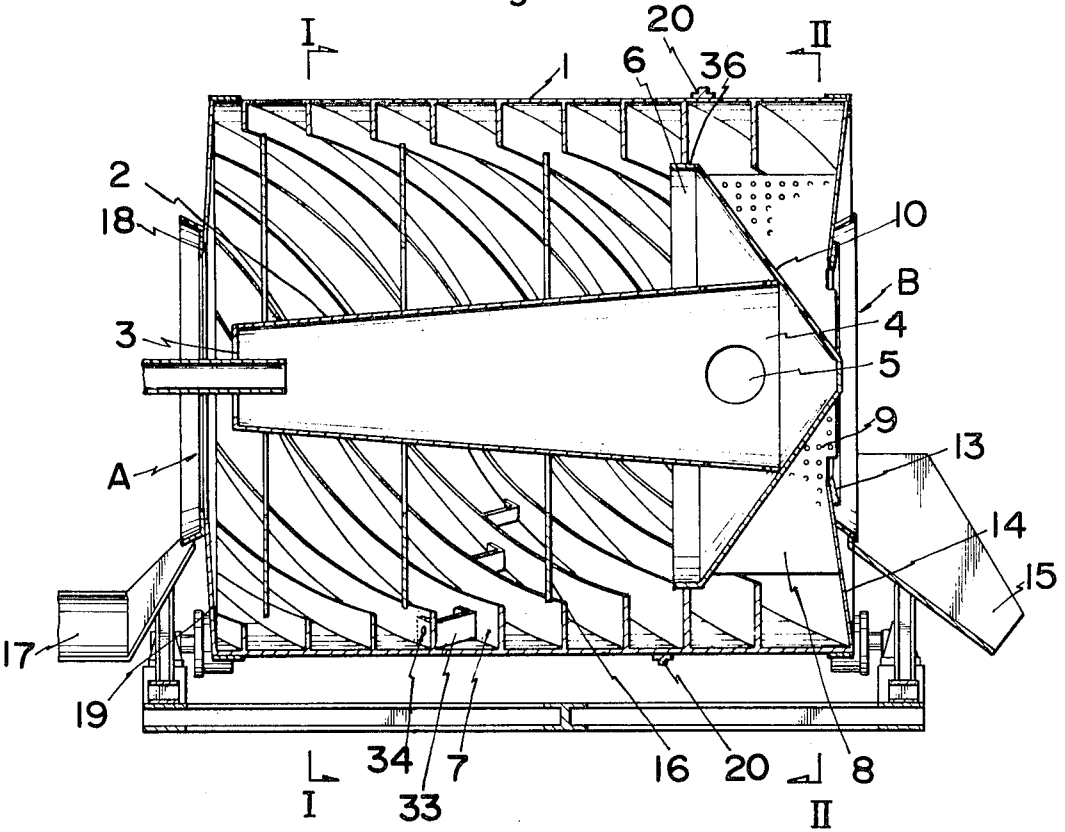
FIG. 1 is a transverse cross-sectional view of the basic type of rotary sand classifier of this invention.
Figure 5:
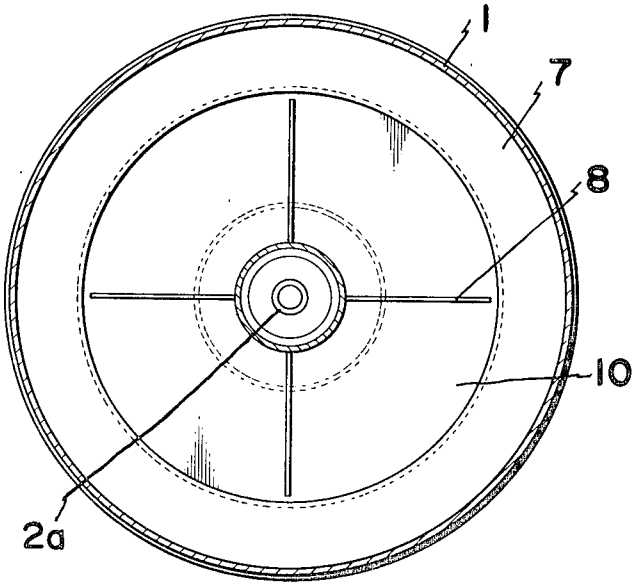
FIG. 5 is a cross-sectional longitudinal view of the above sand classifier of FIG. 1 taken along the line II—II.
Figure 4:
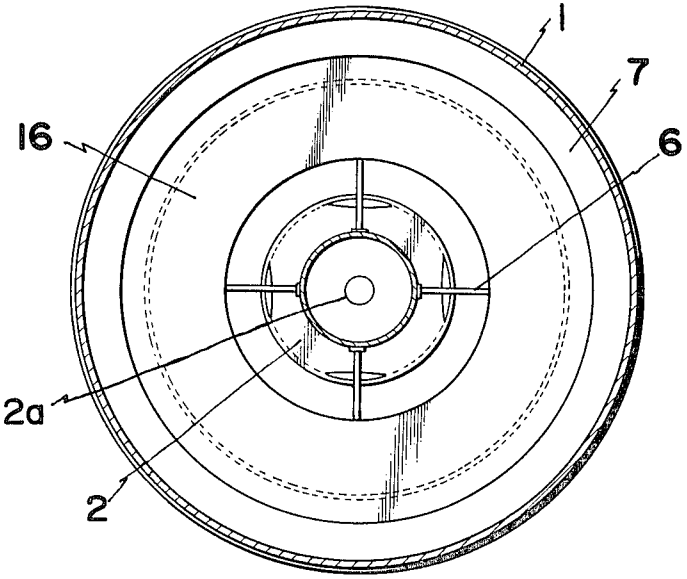
FIG. 4 is a cross-sectional longitudinal view of the above sand classifier of FIG. 1 taken along the line I—I.

In this embodiment, as shown in FIG. 1, a rotary drum 1 encloses a feed pipe 2 which is concentric within the drum 1. The pipe 2 has an inlet 3 at the front end into which the muddy water is introduced and an outlet 4 at the rear end. The rear end portion of the pipe has a plural number of openings 5 formed thereon. If desired, such rear end portion can be fabricated by an expanded metal mesh. The diameter of the pipe 2 gradually increases from the front end to the rear end. Furthermore, the pipe 2 is supported by a plurality of frames 6 which extend radially from the outer surface of the rear end of the pipe 2 with one end of the respective frames 6 being secured to the rear of the pipe 2 and the other end of the respective frames 6 being secured to the upper portion of the respective helicoid blades 7. A plurality of helicoid blades 7 of the same pitch are fixedly secured to the inner surface of the drum 1 along the entire length of the drum 1 having their respective rearmost ends terminating at the rear end plate of the rotary drum 1. Therefore, no acute angled corners which are formed where the helicoid blades and paddles meet in a conventional apparatus are formed in this invention. A cone-shaped chute 10 is concentric with and located at the rear end of the drum 1; it is an integral part of the drum 1 with the base of the conical shape being secured to the inward peripheries of the helicoid blades 7. A plurality of triangular paddles are fixedly mounted on the inclined face of the conical chute 10 equidistantly and radially while having their enlarged side abut with the inward periphery of the helicoid blades 7. Each paddle 8 has a number of apertures 9 thereon. An adjustable circular plate 13 is removably mounted on the outer periphery of a circular rear end weir plate 14 which has an inclined surface that is secured to the sides of the paddles 8. B indicates an outlet from which classified sand is discharged. The discharged sand is cast into a discharge chute 15. Numeral 16 indicates a plurality of ring-like baffle plates which are disposed along the length of drum 1 at regular intervals. The outer portion of each baffle plate 16 is attached to a helicoid blade 7 while the inner portion remains free and extends toward the central axis of the drum 1. A indicates an outlet through which the supernatant water is carried to a water discharge chute 17. The discharged supernatant water is delivered to a reservoir by a suitable means such as a pump (not shown in drawings). Numeral 18 indicates an adjustable circular plate which is removably mounted on the front of plate 19, the outer periphery of which in turn is secured to the frontmost edge of the drum 1.

With reference to FIG. 2, a plurality of teeth 20 are fixedly attached to the outer circumference at the midsection of the drum 1. An endless chain 21 is extended between the drum 1 and a first sprocket wheel 22 which is fixedly mounted on a shaft 23. Numeral 25 indicates an endless chain which is extended between the second sprocket wheel 24 and a third sprocket wheel 26 that is fixedly mounted on a shaft of a motor 27. Numeral 28 indicates a base on which the above sprockets and the motor 27 are mounted. The drum 1 is rotatably supported by plural pairs of rollers 29. Each roller 29 is fixedly mounted on shafts 30 which have both ends journal mounted in bearings 31. Bearings 31 are fixedly mounted on a frame structure 32.

Figure 6:
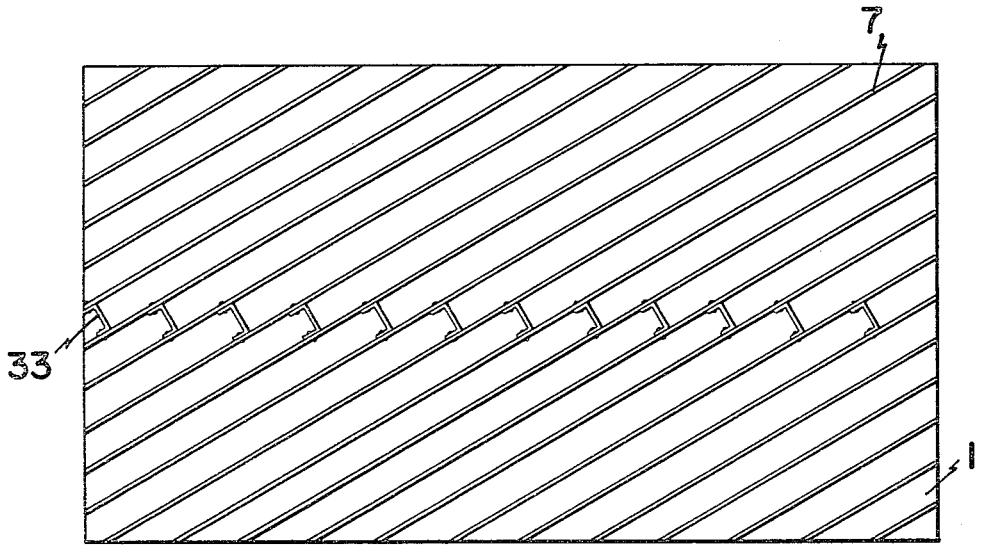
FIG. 6 is a developed view of the drum of the apparatus of FIG. 1 showing the relationship of the helicoid blades and the blockade plates.
Figure 7:
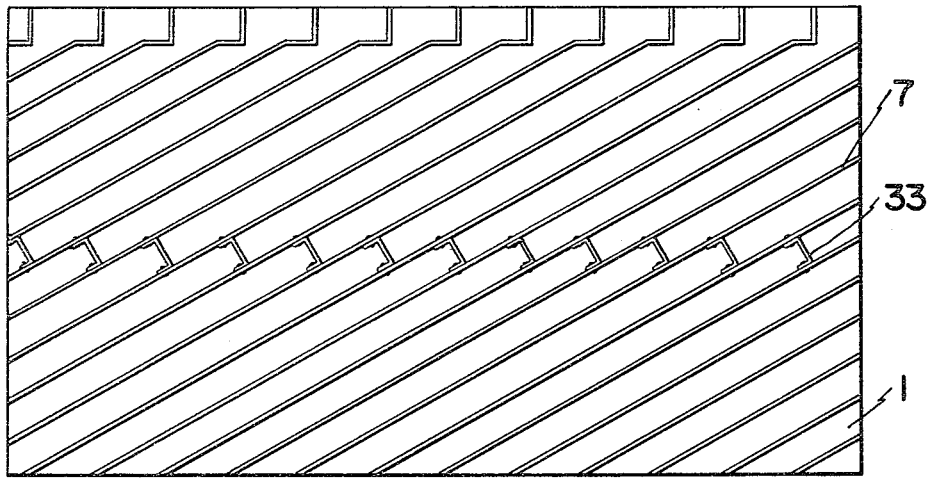
FIG. 7 is a developed view of the drum of a conventional apparatus showing the relationship of the helicoid blades, paddles and the blockade plates.

Referring to FIGS. 1 and 6, a plurality of blockade plates 33 are shown which are disposed along the inner circumference of the drum at required longitudinal positions, wherein each plate 33 is inserted between two helicoid blades 7 and has both sides secured to the side of the blades 7 by bolts 34. The height of the plates 33 is preferably half that of the blades 7.

The manner in which the apparatus is operated is hereinafter described with reference to the individual operation of the parts of the apparatus.

Figure 11:
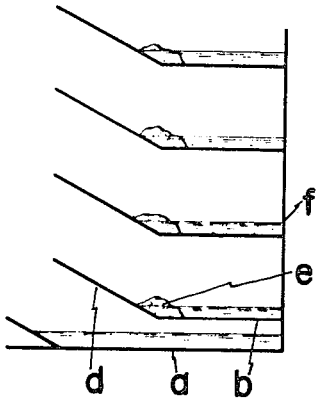
FIG. 11 is a pictorial view showing the portion where the sand scooping paddles and the rear end wcir plate meet in a conventional apparatus.

The muddy water which contains sand is continuously supplied to the front inlet 3 of the feed pipe 2 while the drum 1 is rotated by the motor 27. Since the feed pipe 2 has a diameter which gradually and continuously increases toward the rear end of the pipe 2 and also has a desired number of openings 5 at the rear end of the pipe, the muddy water which is introduced into the pipe 2 passes through the openings 5 and is dispersed downwardly into the drum 1. Some of the remaining flow of water may pass downward from the outlet 4 of the pipe 2. Therefore, the muddy water loses flow energy or velocity and no vortices, which would prevent the sand from settling, occur at the point where the falling water hits the surface of the water in the drum 1. Accordingly, the sand is allowed to settle smoothly within the drum 1 which results in improvement of the classification. The muddy water is then forced to overflow the plurality of baffle plates 16 and move towards the water discharge outlet A located at the front end of the drum 1. During the above-mentioned movement of the muddy water in the direction of the water discharge outlet A, sand particles which have a specific gravity that is greater than that of water settle onto the bottom of the drum 1, bumping into the baffle plates 16 and losing their flow energy. Then the settled sand is transferred by the rotation of the helicoid blades 7 to the rear end of the drum 1 where a plurality of paddles 8 are disposed. Furthermore, the movement of sand containing some settled mud towards the discharge outlet A is prevented by a number of blockade plates 33 where the blockaded sand is moved along the inner surface of the drum 1 by the rotation of the drum 1. When the sand is transferred to the "top dead point" where it slides into the blockade plates 33, the sand falls onto the upper portion of the feed pipe 2 and then is scattered into the water. The scattered sand or mud components move in one of the directions in the water as shown in FIG. 9 depending on the size and specific gravity of the sand, wherein a indicates the direction of mud particles; b the direction of minute sand particles; c the direction of coarse particles and F the flow direction of the muddy supernatant water. By the repetition of the above actions where the effect is proportional to the number of blockade plates 33 that are attached, the particle size distribution of the classified sand is adjustable. Then, as shown in FIG. 10, when the settled sand is transferred toward the rear portion of the rotary drum 1 corresponding to the slow rotation of the drum 1, the settled sand eventually accumulate at the deepest corner area formed by the helicoid blade 7, drum 1 and the rear circular weir plate 14. In other words, the so-called "water dam" which appears between the circular weir plate 14 and accumulated settled product at the deflected corner (please refer to FIG. 11) in the conventional apparatus is not formed. Subsequently, as the sand is moved along the inner surface of the drum 1 towards the upper portion due to the rotation of the drum 1, the sand is slid from the helicoid blades 7 to the paddles 8 provided with a number of apertures 9 and the water which is present in the above sand at a considerably low degree is now entirely eliminated through a number of apertures 9 in each paddle 8. When the sand which is free of water is transferred to a location directly above the cone-shaped discharge means 10, the sand is cast onto the inclined surface of the discharge means 10.

Since a necessary number of paddles 8 are fixedly secured to the inclined surface of the discharge means 10, the sand slides along the inclined surface and is discharged from the discharge outlet B.

Meanwhile, the supernatant water, which is the remainder of the muddy water after the sand of the required size range has settled onto the bottom of the drum 1, overflows out the discharge outlet A into the water discharge chute 17. The water is then transferred to a reservoir by a suitable mean such as a power-operated pump.

Referring to other features of the rotary sand classifier of this embodiment, the classifier of this embodiment is further characterized by having a water-flow regulating structure which prevents the settled sand disposed between helicoid blades from being agitated by water flowing into the drum by way of the feed pipe.

Namely, a circular covering plate 36 which has a desired axial width is secured to the base portion of the cone-shaped chute 10 covering the rear of the helicoid blades 7.

Figure 12:
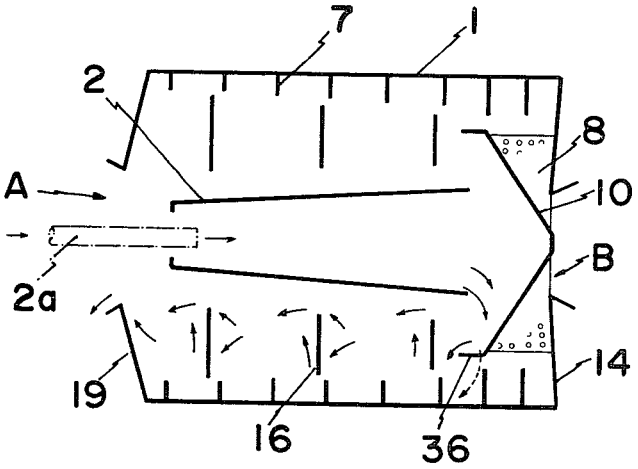
FIG. 12 is an explanatory view showing the flow of waste or muddy water within the drum of the apparatus of this invention.

In general, conventional classifiers do not have the circular covering plate 36. The waste water which falls into the drum from the outlet of the feed pipe 2 flows into the places between the helicoid blades 7 at a location below the outlet of the feed pipe 2 as shown in the dotted line in FIG. 12 and thereby causes the vortices.

Accordingly, the smaller the particle size of the product which settles between each two helicoid blade becomes, the greater the settled product is agitated. Therefore, the settled product is not transferred toward the scooping paddles 8 which results in the supernatant water containing the above whirled once-settled product.

In this invention, by employing the circular covering plate 36 which covers the helicoid blades 7 at the above-mentioned location, the flow direction can be changed so that the occurrence of vortices between the helicoid blades 7 can be prevented or regulated.

It is to be noted, however, that there must be enough space between the circular covering plate 36 and the ring-like baffle plates 16 to which the waste water first hits such that the settled product does not accumulate on the inner wall of the circular covering plate 36.

The minute particles contained in the waste water generally settle onto the bottom of the drum 1 between the helicoid blades 7 at a location far from the outlet of the feed pipe 2, namely, the point closest to the supernatant water discharge A where the dam, formed by the waste water is the most stable. After settling, the particles are transferred along the helicoid blades 7 toward the rear of the drum 1 by the rotation of the drum 1 as shown in FIG. 1 and reach a location just below the outlet of the feed pipe 2.

Since the water energy of the falling waste water does not affect the water between the helicoid blades which are covered by the covering plate 36, the settled minute particles are not affected by the energy and pass below the circular covering plate 36 and are smoothly charged into the deepest corners of the rotary drum 1 which are formed by the rear weir plate 14 and the helicoid blades 7. Thus, the transferred particles are then raised upward by the scooping paddles while being separated from the water by the rotation of the drum and are discharged downward onto the cone-shaped chute 10.

The Second Embodiment

Figure 13:
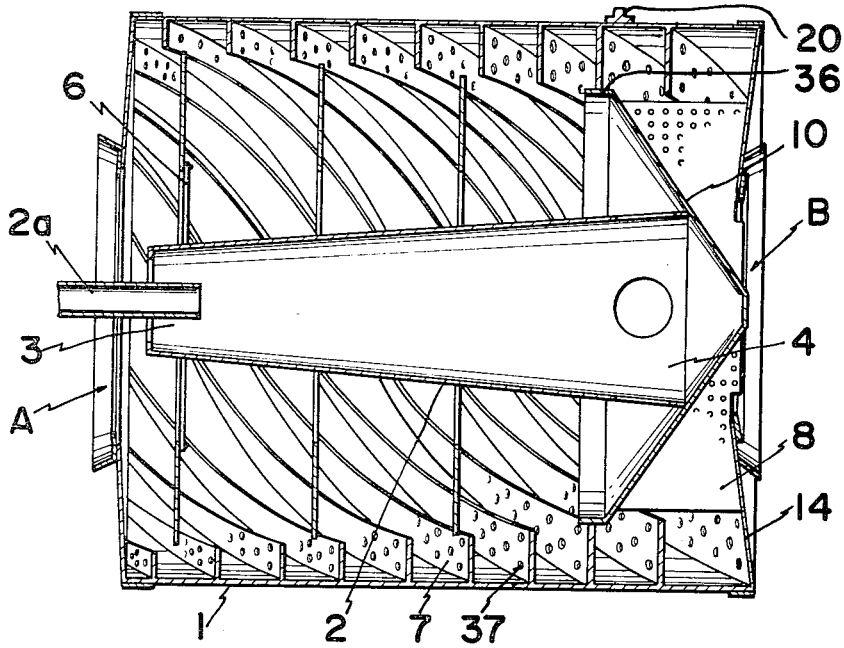
FIG. 13 is a transverse cross-sectional side view of the second embodiment of the apparatus of this invention.
Figure 14:
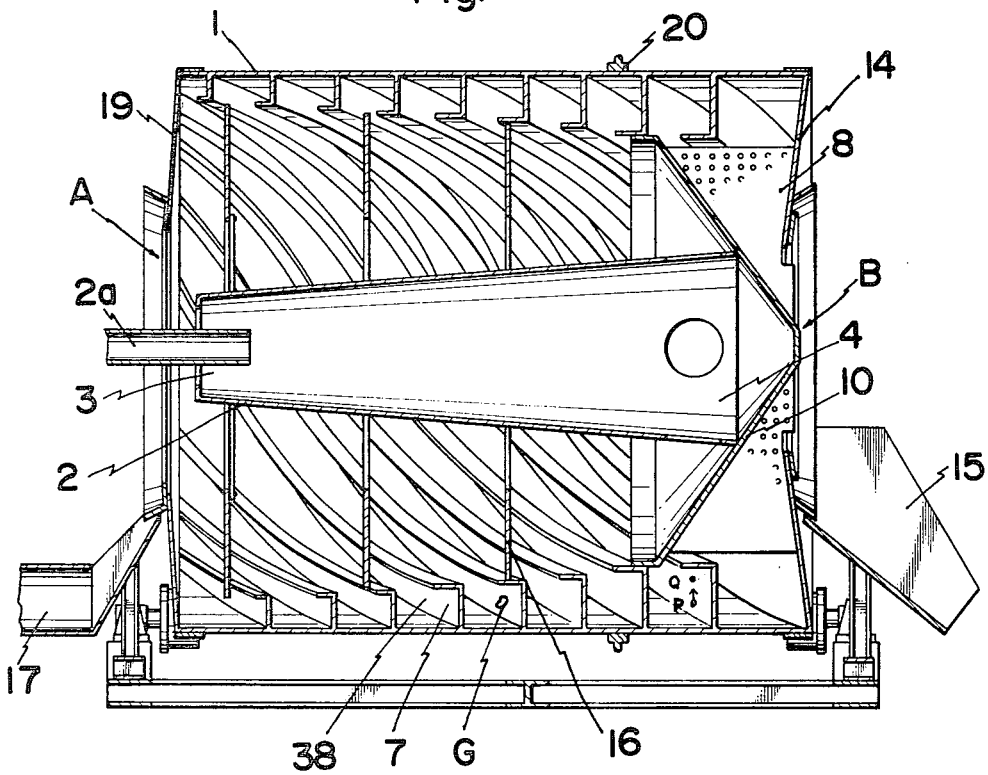
FIG. 14 is a transverse cross-sectional side view of the third embodiment of the apparatus of this invention.

The rotary-type sand classifier of this embodiment which is shown in FIG. 13 is characterized by having a plurality of perforated helicoid blades for transferring the settled sand toward the sand discharging means located at the rear of the rotary drum.

In the apparatus of the first embodiment as well as in conventional apparatuses, the helicoid blades 7 which are secured to the inner periphery of the rotary drum 1 are formed by solid elongated plates.

Therefore, when the rotary drum 1 is rotated by a suitable rotating means, the rotation thereof causes not only the transfer of settled sand toward the rear end of the drum but also the slight agitation of the muddy water in the space between each two helicoid blades as well as the sand settled in the space.

This phenomenon is especially remarkable when the sand composed of extremely minute particles must be classified since they tend to easily whirl out from the space between each two helicoid blades 7.

Accordingly, this embodiment relates to the rotary-type sand classifier which can resolve the above problems.

In this embodiment, as has been described heretofore, the helicoid blades 7 for transferring sand are now provided with a multiplicity of apertures 37 thereon.

The above perforated blades 7 may be made of expanded metal mesh, if desired.

Due to the above specific construction, when the rotary drum 1 is slowly rotated, the muddy water defined by each two helicoid blades 7 pass through the apertures 37 so that the thrust (force) which is usually exerted by the conventional solid helicoid blades 7 and which causes the whirling of minute settled sand particles from the space between each two helicoid blades 7 does not occur. Although apertures 37 may be clogged by a "bridge" formed by sand particles when the helicoid blades 7 are made of expanded metal mesh, the above performance of the apertures 37 is maintained substantially equal since such a bridge is still permeable.

Furthermore, the apertures 37 which are effective in obviating the occurrence of adverse thrust also facilitates the easy rotation of the rotary drum 1 since the helicoid blades 7 are subject to the less amount of water pressure when the rotary drum 1 is rotated.

Accordingly, besides the advantages set forth in the previous embodiment, the apparatus of this embodiment has the following advantage that the settled sand can be efficiently transferred to the rear sand discharge portion of the rotary drum 1 corresponding to the smooth rotation of the rotary drum.

The Third Embodiment

This embodiment discloses a rotary-type classifier which is most suitable for separating and discharging flocculated material obtained by flocculating suspended matter in waste water.

The inventor has already disclosed a rotary-type classifier for classifying sand and the like in the foregoing embodiments. However, when the classifier is directly applied to the disposal of waste water which may contain suspended matter as well as minute sand particles it does not work well due to its construction. It is because the flocculated material which is produced as colloidal particles by adding a high molecular weight coagulant to the waste water, have a lower specific gravity compared to sand so that even when they are settled between the helicoid blades which are fixedly secured to the inner peripheral surface of the drum, the settled flocculated product is dispersed into the waste water again by the rotation of the drum and can not be smoothly transferred to the discharge end of the drum.

In this embodiment (FIG. 14 through FIG. 17), numeral 38 indicates a space confined by the helicoid blades which are formed to serve the complete transferring of the settled flocculated material from the drum and G indicates flocculated material or particles.

Figure 15:
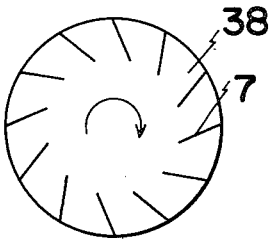
FIG. 15 through FIG. 17 are schematical cross-sectional views of the classifier of the second modification showing the various types of helicoid blades attached to the inner surface of the drum.
Figure 16:
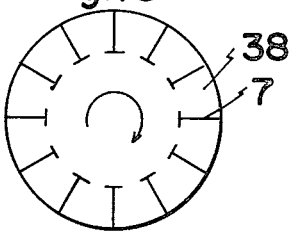
Figure 17:
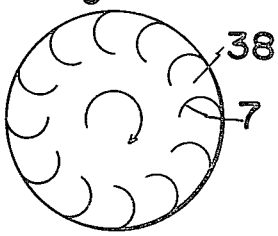

In FIG. 15 through FIG. 17, helicoid blades with various types of cross-sections are shown.

The manner in which the apparatus of this embodiment is operated is hereinafter disclosed.

First, the waste water is charged into the drum 1 through the waste water introduction pipe 2*a* and the inversely tapered feed pipe 2. The high-molecular weight coagulants can be added either before or after the waste water is charged into the drum 1 to form the flocculated material. The waste water which is then charged into the drum 1 forms a dam within the drum which has the cross-section of a segment of a circle. The waste water in the drum is then transferred toward the supernatant water discharge opening A. In the above flow of the water, the flocculated material suspended in the waste water is caused to settle downward by the action of the ring-like baffle plates 16 and settles into the areas between each two helicoid blades 7. The helicoid blades 7 which are an integral part of the drum, rotate in the direction of the arrow as shown in FIG. 15 through FIG. 17.

Since the space 38 between each two helicoid blades 7 has a narrow opening directed in the rotating direction of the drum 1, the flocculated particles G which settle between each two helicoid blades 7 do not escape from the narrow opening due to the configuration of the helicoid blades 7 even though they may be displaced from (p) to (q) within the space as the drum is rotated.

In this manner the flocculated material which is confined to the space is smoothly transferred along the surfaces of the helicoid blades 7 toward the rear of the drum 1 and subsequently is charged onto the scooping paddles 8 which are radially disposed at the rear of the drum 1. The flocculated material is then raised upward by the scooping paddles corresponding to the rotation of the drum 1 so that the water is separated from the scooped flocculated material and the material slides towards and onto the paddles, then onto the cone-shaped chute 10 which eventually discharges the flocculated material through the settled product discharge opening B. The supernatant water which is free from the above flocculated material is discharged from the supernatant water discharge opening A.

As has been described heretofore according to this invention, since the helicoid blades 7 are shaped and secured to the inner peripheral surface of the drum in such a way that the space 38 between each two helicoid blades 7 has a narrow upper opening in a direction which corresponds to the rotating direction of the drum 1, even the settled product of a low specific gravity such as a flocculated product can be smoothly transferred whereby the removal of flocculated material can be achieved.

The Fourth Embodiment

The sand classifier of this embodiment is characterized in that the perforated scooping paddles have their distal ends secured to the inner rear periphery of the rotary drum and that the peripheral portion 8*a* of the above scooping paddles 8 have a height equal to the height of the adjoining helicoid blades and are also deflected at a desired angle from the axial direction of the drum 1.

Figure 19:
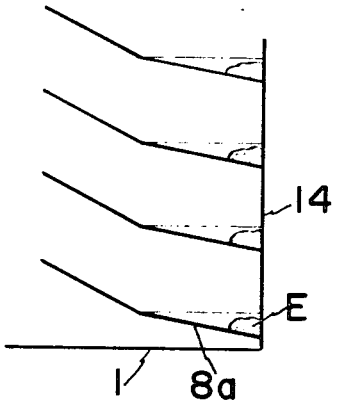
FIG. 19 is a pictorial view showing the portion where the helicoid blades and the scooping paddles meet in the third modification.

Due to the above construction of the helicoid blades as shown in FIG. 19, the angle formed by a helicoid blade 7 and the peripheral portion 8*a* of the scooping paddle 8 is approximately 180° so that the settled product E which is transferred from the helicoid blade 7 does not accumulate at the deflected area but accumulates at the deepest corner area formed by the scooping paddle 8, drum 1 and the circular weir plate 14. In other words, the so called "dam" which appears between the circular weir plate 14 and the accumulated settled product in conventional apparatuses is not formed so that water separation is effectively conducted as the accumulated settled product is lifted up by the peripheral portion 8*a* of the individual perforated scooping paddle 8.

Figure 18:
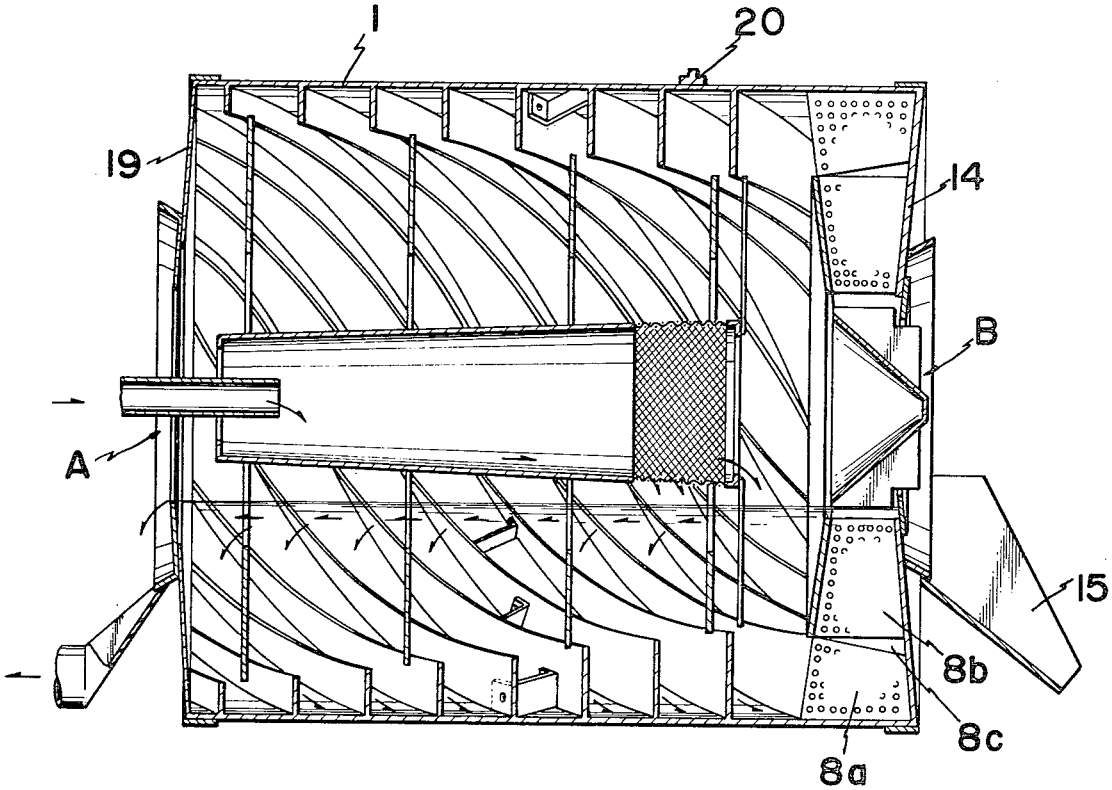
FIG. 18 is a transverse cross-sectional side view of the fourth embodiment of the apparatus of this invention.

Furthermore it is desirable that the peripheral portion 8*a* of the scooping paddle 8 be nearly severed from the inner portion 8*b* thereof as shown in FIG. 18 and that the triangular openings 8*c* are formed by disposing the inner portion 8*b* slightly behind the peripheral portion 8*a* relative to the rotation of the drum 1. The above-mentioned construction of the scooping paddle 8 relative to the helicoid blade 7 can be formed by twisting the scooping paddle 8.

The triangular cut 8*c* acts as an opening through which the water passes so that the energy required to rotate the drum is decreased as the settled product is elevated.

What we claim is:

1. A wet-type rotary sand classifier comprising;

(1) a rotary drum having a supernatant water outlet at the front end thereof and a classified sand outlet at the rear end thereof, (2) a feeding means for feeding muddy water containing sand into said drum, said feeding means being enclosed concentrically within said drum and attached to said drum for rotation with said drum, (3) a transferring means for transferring sand settled onto the bottom of said rotary drum toward the rear portion of said drum, said transferring means comprising a plurality of helicoid blades of the same pitch which are fixedly secured to the entire inner wall of said drum with their rearmost end terminating at the rear end of said drum, said helicoid blades being of a height which gradually increases toward the rear end of said drum, (4) a said discharging means disposed at said rear portion of said rotary drum, said discharging means comprising;

(a) a cone-shaped chute having the base portion thereof secured to the inner peripheries of said helicoid blades, (b) a plurality of water separation perforated paddles equidistantly and radially disposed over said cone-shaped chute, each of said paddles having their radially distal ends thereof secured to the corresponding inner peripheries of rear ends of said helicold blades and their inclined sides secured to the corresponding inclined surface of said coneshaped chute, whereby the settled sand is transferred to the rearmost corners of said drum formed by said helicoid blades and is raised upward by said paddles containing little water therein so that the discharged sand from said sand discharging outlet is substantially free of water.

2. A wet-type rotary sand classifier according to claim 1, wherein said each helicoid blade has a number of apertures on the entire surface thereof for passing the muddy water therethrough.

3. A wet-type rotary sand classifier according to claim 1, wherein said conical-shaped chute is provided with a circular covering plate which has the rear periphery thereof attached to said base portion coaxially, said covering plate covering the rear end of said helicoid blades whereby the muddy water between said helicoid blades at the rear of said drum is not agitated by the falling of the muddy water into said drum through said feeding means.

4. A wet-type rotary sand classifier according to claim 1, wherein said helicoid blades are shaped such that a space formed by each two helicoid blades has a narrow opening directed in the rotating direction of said drum whereby even flocculated material which is settled into said space can be transferred along said helicoid blades without escaping from said space.

5. A wet-type rotary sand classifier comprising;

(1) a rotary drum having a supernatant water outlet at the front end thereof and a classified sand outlet at the rear end thereof, (2) a feeding means for feeding muddy water containing sand into said drum, said feeding means being enclosed concentrically within said drum and attached to said drum for rotation with said drum.

(3) a transferring means for transferring sand settled onto the bottom of said rotary drum toward the rear portion of said drum, said transferring means comprising a plurality of helicoid blades of the same pitch which are fixedly secured to substantially the entire inner wall of said drum except for the rear portion of said drum, said helicoid blades being of a height which gradually increases toward the rear end of said drum, (4) a sand discharging means disposed at said rear portion of said rotary drum, said sand discharging means comprising;

(a) a plurality of water separation perforated paddles equidistantly and radially disposed around the inner periphery of said rotary drum, (b) a cone-shaped chute having an exterior inclined surface which has a plurality of partitions fixedly secured to said inclined surface toward the apex of said cone-shaped chute, (c) said each paddle having the distal portion which is secured to the inner surface of said drum while forming a deflected portion of an angle of approximately 180° together with the rear end of said helicoid blades, whereby the settled sand which is transferred from said helicoid blades does not accumulate at said deflected portion resulting in the complete water separation of classified sand.

* * * * *